US006219075B1

(12) United States Patent
Hammond et al.

(10) Patent No.: US 6,219,075 B1
(45) Date of Patent: Apr. 17, 2001

(54) ELECTROPHOTOGRAPHIC MARKING USING AN EXPOSURE STATION HAVING A SMALL WATERFRONT REQUIREMENT

(75) Inventors: Thomas J. Hammond, Penfield; James D. Rees, Pittsford, both of NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/198,548

(22) Filed: Nov. 24, 1998

(51) Int. Cl.[7] ..... B41J 2/385
(52) U.S. Cl. ..... 347/130; 347/241
(58) Field of Search ..... 347/130, 134, 347/138, 140, 238, 241, 244, 245, 256

(56) References Cited

U.S. PATENT DOCUMENTS

| | | | |
|---|---|---|---|
| 3,658,407 | 4/1972 | Kitano et al. | 350/96 B |
| 5,436,691 | 7/1995 | Rees et al. | 355/52 |

OTHER PUBLICATIONS

Office Applications Of Gradient–Index Optics, SPIE vol. 935 Gradient–Index Optics And Miniature Optics (1988) p. 27.

Optical Properties Of GRIN Fiber Lens Array: Dependence On Fiber Length—William Lama, Applied Optics, vol. 21, No. 15, Aug. 1, 1992, p. 2739.

Xerox Disclosure Journal—Method To Lengthen The Total Conjugate Of Fast Gradient Index Arrays, vol. 12, No. 3, May/Jun. 1987.

*Primary Examiner*—N. Le
*Assistant Examiner*—Lamson D. Nguyen
(74) *Attorney, Agent, or Firm*—John M. Kelly

(57) ABSTRACT

A light emitting diode based exposure station (and electrophotographic marking machines that use such exposure stations) that requires only a small amount of photoreceptor waterfront (space). The small waterfront requirement is achieved using a gradient index lens array that transmits focused light onto the photoreceptor with a total conjugate that is sufficient to permit the widest part of the light emitting diode based exposure station to be displaced sufficiently far from the photoreceptor that other printing machine devices can be disposed between the widest part of the exposure station and the photoreceptor. The increased total conjugate is achieved using a gradient index lens array having longer rods and/or wider rods.

10 Claims, 7 Drawing Sheets

ELECTROPHOTOGRAPHIC MARKING USING AN EXPOSURE STATION HAVING A SMALL WATERFRONT REQUIREMENT

FIELD OF THE INVENTION

This invention relates to marking machines that use light emitting diode based exposure stations. In particular, this invention relates to a light emitting diode based exposure station that takes up a small amount of area near a photoreceptor.

BACKGROUND OF THE INVENTION

Electrophotographic marking is a well-known method of copying or printing documents. Electrophotographic marking is performed by first exposing a substantially uniformly charged photoreceptor with a light image representation of a desired document. In response to that light image the photoreceptor discharges, creating an electrostatic latent image of the desired document on the photoreceptor's surface. Toner particles are then deposited onto that latent image, forming a toner image. That toner image is then transferred from the photoreceptor onto a substrate such as a sheet of paper. The transferred toner image is then fused to the substrate, usually using heat and/or pressure, thereby creating a copy of the desired image. The surface of the photoreceptor is then cleaned of residual developing material and recharged in preparation for the production of another image.

The foregoing broadly describes black and white electrophotographic marking. Electrophotographic marking can also produce color images by repeating the above process for each color of toner that is used to make the composite color image. For example, in one color process, referred to as the REaD IOI process (Recharge, Expose, and Develop, Image On Image), a charged photoreceptor is exposed to a light image which represents a first color, say black. The resulting electrostatic latent image is then developed with black toner particles to produce a black toner image. A recharge, expose, and develop process is repeated for a second color, say yellow, then for a third color, say magenta, and finally for a fourth color, say cyan. The resulting composite color image is then transferred and fused onto a substrate.

One way of exposing a photoreceptor is to use a light emitting diode based exposure station. Such exposure stations are generally comprised of an elongated array of discrete light emitting diodes (LEDs) and an array of gradient index lenses that focus the light from the light emitting diodes onto the photoreceptor. To achieve high resolution (usually measured in spots per inch, or SPI), a large number of light emitting diodes are included in the LED array. In practice, each LED images a small area, referred to as a pixel, of the electrostatic image. By selectively driving the LEDs according to video data information a desired electrostatic line image comprised of a large number of individual pixels is produced on the photoreceptor. Since the photoreceptor moves relative to the light emitting diode based exposure station, by exposing the photoreceptor linewise a desired final image can be produced.

In light emitting diode based exposure stations the gradient index lens array is positioned between the light emitting diode array and the surface of the photoreceptor. Gradient index lens arrays, such as those produced under the trade name "SELFOC" (a registered trademark in Japan that is owned by Nippon Sheet Glass Company, Ltd.) are comprising of bundled gradient index optical fibers, or rods, reference U.S. Pat. No. 3,658,407. That patent describes a light conducting rod made of glass or synthetic resin which has a cross-sectional refractive index distribution that varies parabolically outward from the center of the rod. Each rod acts as a focusing lens for light introduced at one end. Relevant optical characteristics of gradient index lens arrays are described in an article entitled "Optical properties of GRIN fiber lens arrays: dependence on fiber length", by William Lama, Applied Optics, Aug. 1, 1982, Vol 21, No. 15, pages 2739–2746. That article is hereby incorporated by reference.

While light emitting diode based exposure stations are generally successful, their use is not without problems. One set of problems relates to their physical size in the process direction. Waterfront is a term for the process direction photoreceptor space that is taken up by a processing station. While light emitting diode arrays and gradient index lenses arrays themselves tend to be narrow, the required physical mounting, electrical drives, and cooling assemblies tend to be wide, in the order of 75 millimeters or so. This creates a problem when attempting to use light emitting diode based exposure stations. Simply put, waterfront is at a premium. A charging system, multiple exposure stations, multiple developers, a transfer station, and a cleaning station all must be located adjacent the photoreceptor. When designing an electrophotographic marking machine with the light emitting diode based exposure stations the waterfront requirements of the exposure stations directly impact cost.

A way of increasing the waterfront is to use a longer conjugate lens. However, long conjugate lenses are typically less radiometrically efficient or have lower resolution.

Therefore, radiometrically efficient light emitting diode based exposure stations having reduced waterfront requirements would be beneficial. Even more beneficial would be electrophotographic marking machines that use light emitting diode based exposure stations having a reduced waterfront requirement.

SUMMARY OF THE INVENTION

This invention relates to a light emitting diode based exposure station having a reduced waterfront requirement, and to electrophotographic marking machines that use such reduced waterfront light emitting diode based exposure stations.

According to the principles of the present invention the small waterfront requirement is achieved using a gradient index lens array that transmits focused light onto the photoreceptor with an increased total conjugate that permits the widest part of the light emitting diode based exposure station to be displaced sufficiently far from the photoreceptor that other printing machine devices can be disposed between the widest part of the exposure station and the photoreceptor. The increased total conjugate is achieved using a gradient index lens array having longer and/or larger diameter rods. This increases the total conjugate without sacrificing the radiometric efficiency.

BRIEF DESCRIPTION OF THE DRAWINGS

Other aspects of the present invention will become apparent as the following description proceeds and upon reference to the following drawings, in which like reference numerals identify like elements and wherein.

DETAILED DESCRIPTION OF AN EMBODIMENT OF THE INVENTION

Figure 1:
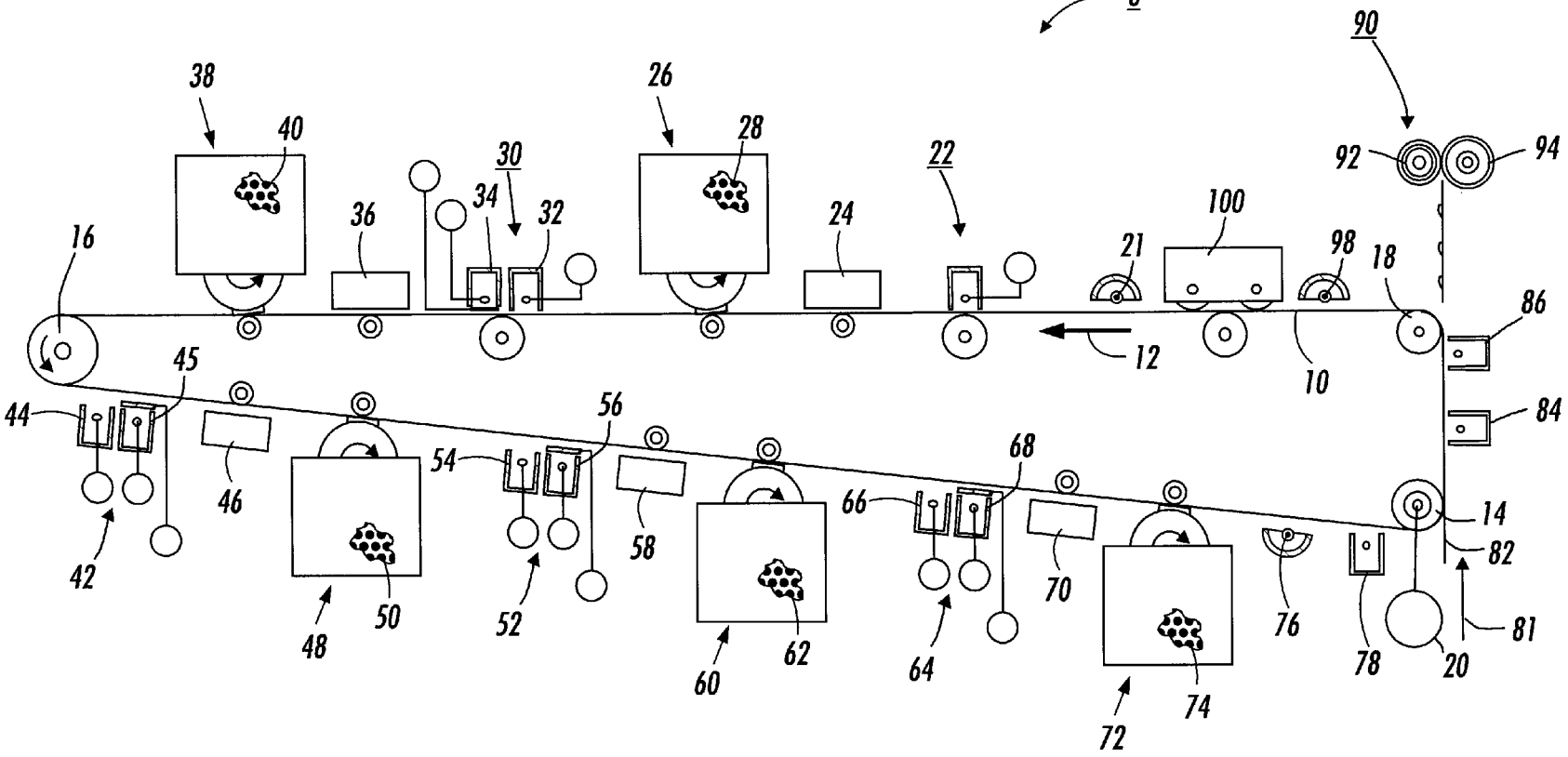
FIG. 1 illustrates an electrophotographic printing machine.

FIG. 1 illustrates an electrophotographic printing machine 8 that is in accord with the principles of the present invention. While the printing machine 8 is a single pass, Recharge-Expose-and-Develop, Image-on-Image (REaD IOI) printer, it is to be understood that the present invention is applicable to many other types of systems. For example, the present invention may find use in multiple pass color printers in which the Recharge-Expose-and-Develop, Image-on-Image process is not used. Such printers often use intermediate transfer belts and produce color images that are individually transferred onto the intermediate transfer belt. The present invention may also find use in black and white printers or in digital copiers. Therefore, it is to be understood that the following description of the printing machine 8 is used to explain the principles of the present invention, not to limit them.

The printing machine 8 includes an Active Matrix (AMAT) photoreceptor belt 10 which travels in the direction indicated by the arrow 12. Belt travel is brought about by mounting the photoreceptor belt about a driver roller 14 and tension rollers 16 and 18. The driver roller 14 is rotated by a motor 20.

As the photoreceptor belt travels each part of it passes through each of the subsequently described process stations. For convenience, a single section of the photoreceptor belt, referred to as the image area, is identified. The image area is that part of the photoreceptor belt which is to receive the various actions and toner layers that produce the final composite color image. While the photoreceptor belt may have numerous image areas, since each image area is processed in the same way a description of the processing of one image area suffices to explain the operation of the printing machine 8.

The imaging process begins with the image area passing a "precharge" erase lamp 21 that illuminates the image area to erase any residual charge which might exist on the image area. Such erase lamps are common in high quality systems and their use for initial erasure is well known.

As the photoreceptor belt continues its travel the image area passes a charging station comprised of a DC corotron 22. The DC corotron charges the image area in preparation for exposure to create a latent image for black toner. For example, the DC corotron might charge the image area to a substantially uniform potential of about −500 volts. It should be understood that the actual charge placed on the photoreceptor will depend upon many variables, such as the black toner mass that is to be developed and the settings of the black development station (see below).

After passing the charging station the image area advances to a first light emitting diode based exposure station 24. That exposure station exposes the charged image area such that an electrostatic latent representation of a black image is produced. For example, the exposed portions of the image area might be reduced in potential to −50V (while the unexposed portions remain at −500V). The printing machine 8 departs from prior art printing machines most directly with regards to the light emitting diode based exposure station 24 and its physical relationship to other process stations. Therefore, a more detailed description of the light emitting diode based exposure stations and their physical relationships to other process stations are given subsequently.

Still referring to FIG. 1, after passing the exposure station 24 the now exposed image area with its black latent image passes a black development station 26 that deposits black toner 28 onto the image area so as to produce a black toner image. While the black development station 26 could be a magnetic brush developer, a scavengeless developer may be somewhat better. One benefit of scavengeless development is that it does not disturb previously deposited toner layers. Developer biasing is such as to effect discharged area development (DAD) of the lower (less negative) of the two voltage levels on the image area. Therefore, the charged black toner 28 adheres to the exposed areas of the image area.

After passing the black development station 26 the image area advances to a recharging station 30 comprised of a DC corotron 32 and an AC scorotron 34. The recharging station recharges the image area and its black toner layer using a technique known as split recharging. Split recharging is described in U.S. Pat. No. 5,600,430, which issued on Feb. 4, 1997, and which is entitled, "Split Recharge Method and Apparatus for Color Image Formation." Briefly, the DC corotron 38 overcharges the image area to a voltage level greater than that desired when the image area is recharged, while the AC scorotron 40 reduces that voltage level to that which is desired. Split recharging serves to substantially eliminate voltage differences between toned areas and untoned areas and to reduce the level of residual charge remaining on the previously toned areas. This benefits subsequent development by different toners. Of course, other recharging schemes could also be used.

The now recharged image area with its black toner layer then advances to a second light emitting diode based exposure station 36. That exposure station exposes the recharged image area such that electrostatic latent representation of a yellow image is produced. Significantly, the second light emitting diode based exposure station 36 is controlled such that the yellow image is in registration with the black toner image on the image area.

The now re-exposed image area then advances to a yellow development station 38 that deposits yellow toner 40 onto the image area. After passing the yellow development station the image area advances to a recharging station 42 here a DC scorotron 44 and an AC scorotron 45 split recharge the image area as described above.

The now recharged image area with its black and yellow toner layers is then exposed by a third light emitting diode based exposure station 46 to produce an electrostatic latent representation of a magenta image. Significantly, the third light emitting diode based exposure station 46 is controlled such that the magenta image is in registration with the black toner image and the yellow toner image on the image area After passing the magenta exposure station the now re-exposed image area advances to a magenta development station 48 that deposits magenta toner 50 onto the image area. After passing the magenta development station the image area advances to another recharging station 52 where a DC corotron 54 and an AC scorotron 56 split recharge the image area as previously described.

The recharged image area with its three toner layers then advances to a fourth light emitting diode based exposure station 58. That exposure station exposes the now recharged image area such that an electrostatic latent representation of a cyan image is produced. Significantly, the fourth light emitting diode based exposure station 58 is controlled such that the cyan image is in registration with the black, yellow, and magenta toner images already on the image area.

After passing the fourth light emitting diode based exposure station 58 the re-exposed image area advances past a cyan development station 60 that deposits cyan toner 62 onto the image area.

After passing the cyan development station the image area advances to another recharging station 64 where a DC corotron 66 and an AC scorotron 68 once again split recharge the image area as previously described.

The recharged image area with its four toner layers then advances to a fifth light emitting diode based exposure station 70. That exposure station exposes the now recharged image area such that an electrostatic latent representation for a special toner is produced. The special toner might be custom fabricated to meet the special requirements of the operator of the printing machine 8. Significantly, the fifth light emitting diode based exposure station 70 is controlled such that the special electrostatic latent is in registration with the black, yellow, magenta, and cyan toner images already on the image area.

After passing the fifth light emitting diode based exposure station 70 the re-exposed image area advances past a special development station 72 that deposits special toner 74 onto the image area.

At this time up to five toner layers might be on the image area, resulting in a final, composite color image. However, that composite color image is comprised of individual toner particles which have charge potentials which may vary widely. Directly transferring such a composite toner image onto a substrate would result in a degraded final image. Therefore it is beneficial to prepare the composite color toner image for transfer.

To prepare for transfer a pretransfer erase lamp 76 discharges the image area to produce a relatively low charge level on the image area The image area then passes a pretransfer DC scorotron 78 that performs a pre-transfer charging function. The image area continues to advance in the direction 12 past the driver roller 14. A substrate 82 moving in the direction 81 is then placed over the image area using a sheet feeder (which is not shown). As the image area and the substrate continue their travels they pass a transfer corotron 84 that applies positive ions onto the back of the substrate 82. Those ions attract the negatively charged toner particles onto the substrate.

As the substrate continues its travel is passes a detack corotron 86. That corotron neutralizes some of the charge on the substrate to assist the separation of the substrate from the photoreceptor 10. As the lip of the substrate 82 moves around the tension roller 18 the lip separates from the photoreceptor. The substrate is then directed into a fuser 90 where a heated fuser roller 92 and a pressure roller 94 create a nip through which the substrate 82 passes. The combination of pressure and heat at the nip causes the composite color toner image to fuse into the substrate. After fusing, a chute, not shown, guides the substrate to a catch tray, also not shown, for removal by an operator.

After the substrate 82 is separated from the photoreceptor belt 10 the image area continues its travel and passes a preclean erase lamp 98. That lamp neutralizes most of the charge remaining on the photoreceptor belt. After passing the preclean erase lamp the residual toner and/or debris on the photoreceptor is removed at a cleaning station 100. The image area then passes once again to the precharge erase lamp 21 and the start of another printing cycle.

As previously indicated, differences between prior art printing machines and the printing machine 8 most directly relate to the light emitting diode based exposure stations (the stations 24, 36, 46, and 58 and 70). A light emitting diode based exposure station according to the principles of the present invention has a longer total conjugate than that of prior art light emitting diode based exposure stations. Having a longer total conjugate is highly beneficial because it enables the light emitting diode based exposure stations to take up a smaller waterfront around the photoreceptor.

Figure 2:
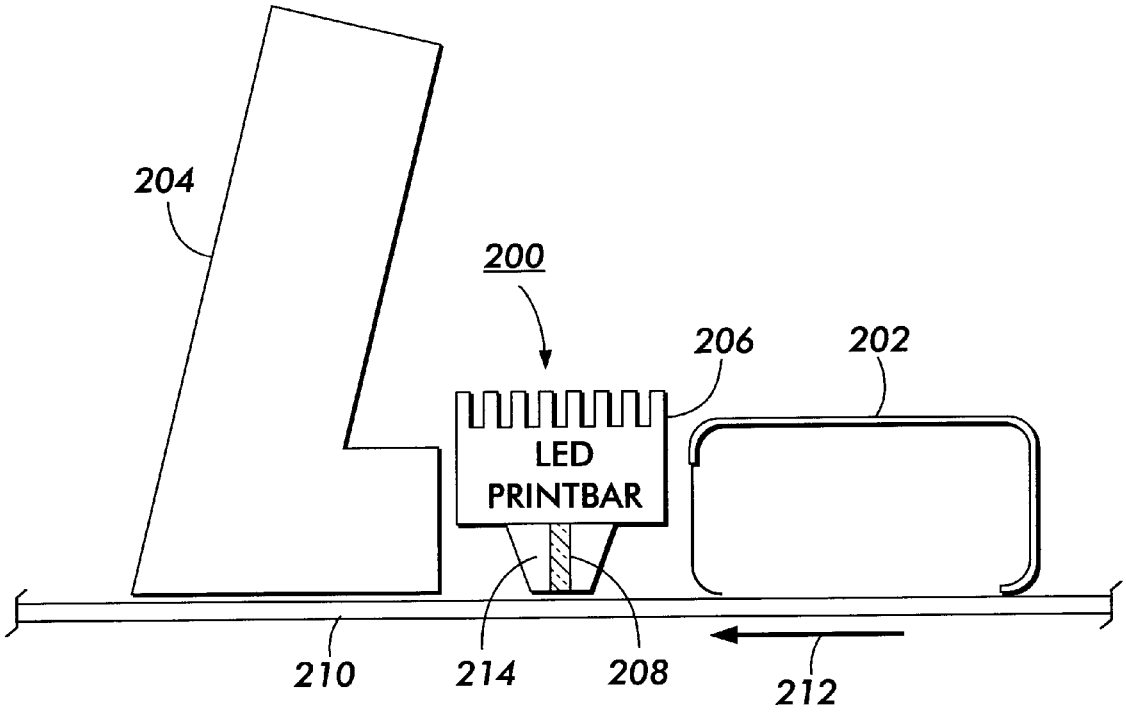
FIG. 2 PRIOR ART
FIG. 2 illustrates how a light emitting diode based exposure station and various marking stations adjacent that light emitting diode based exposure station might be arranged in a prior art electrophotographic printing machine.

To understand this, refer now to FIG. 2, which illustrates how a prior art light emitting diode based exposure station might fit between adjacent processing stations of a printing machine. As shown, a prior art light emitting diode based exposure station 200 is disposed between a charging station 202 and a development station 204. All of these stations are located immediately adjacent a photoreceptor 210 that moves in the direction 212. The light emitting diode based exposure station 200 includes a relatively wide cooling and electronics assembly 206 and a relatively narrow gradient index lens array 208 within a mount 214. It is to be understood that a light emitting diode array (which is not shown) is mounted in thermal communication with the cooling and electronics assembly 206 and in optical communication with the photoreceptor 210 via the gradient index lens array 208. While the actual width of the cooling and electronics assembly 206 will depend upon many factors, such assemblies having widths of around 75 millimeters are common. In contrast, mounts might have widths of around 10 millimeters. In the prior art, the charging station 202 and the development station 204 had to be separated by at least the maximum width of the light emitting diode based exposure station 200.

Figure 3:
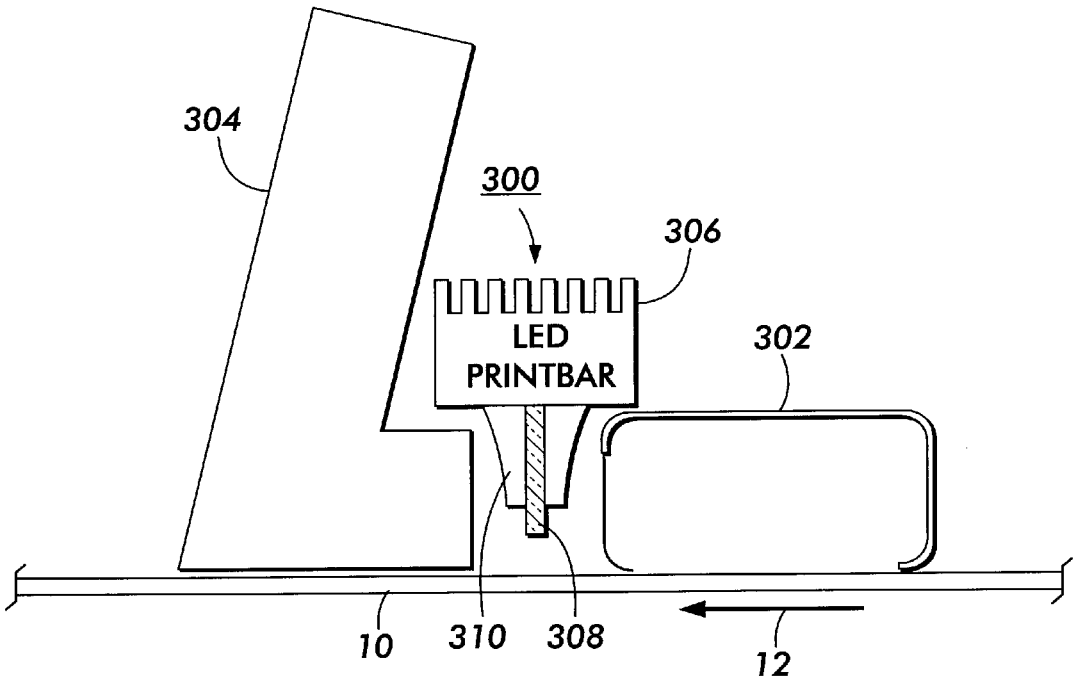
FIG. 3 illustrates how the light emitting diode based exposure station and various marking stations adjacent that light emitting diode based exposure station are physically arranged in accordance with the principles of the present invention.

In contrast, refer now to FIG. 3 for an illustration of the present invention: how light emitting diode based exposure stations physically fit between adjacent processing stations of the printing machine 8. As shown, a light emitting diode based exposure station 300 is disposed between a charging station 302 and a development station 304 (these designators generically represent the light emitting diode based exposure stations, charging stations, and development stations shown in FIG. 1) These stations are located adjacent the photoreceptor 10. The light emitting diode based exposure station 300 includes a relatively wide cooling and electronics assembly 306 and a gradient index lens array 308 within a much narrower mount 310. Furthermore, it is to be understood that a light emitting diode array (which is not shown) is mounted in thermal communication with the cooling and electronics assembly 306 and in optical communication with the photoreceptor 10 via the gradient index lens array 308. However, the gradient index lens array 308 has a total conjugate that is greater than the total conjugate of the prior art gradient index lens array 208. This enables the relatively wide cooling and electronics assembly 306 to be located well away from the photoreceptor. Indeed, the cooling and electronics assembly 306 is sufficiently far from the photoreceptor that parts of the charging station 302 and the development station 304 can be disposed between the cooling and electronics assembly 306 and the photoreceptor 10. This enables the charging station 302 and the development station 304 to be separated by less than the maximum width of the light emitting diode based exposure station 300. This reduces the waterfront requirement of the exposure station, which results in closer packing of the system's stations.

Figure 4:
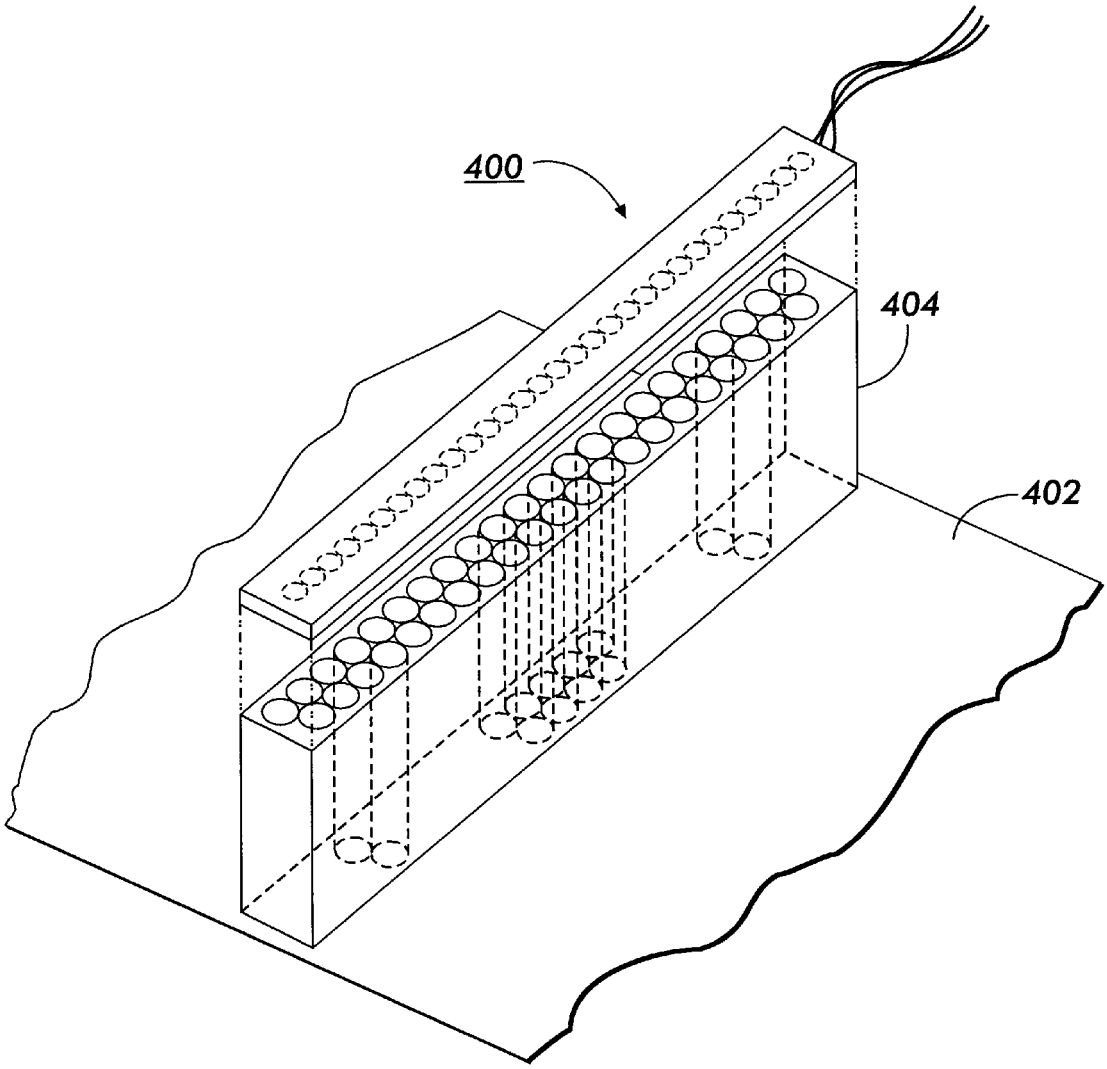
FIG. 4 illustrates a light emitting diode array, a gradient-index lens array, and a photoreceptor.
Figure 5:
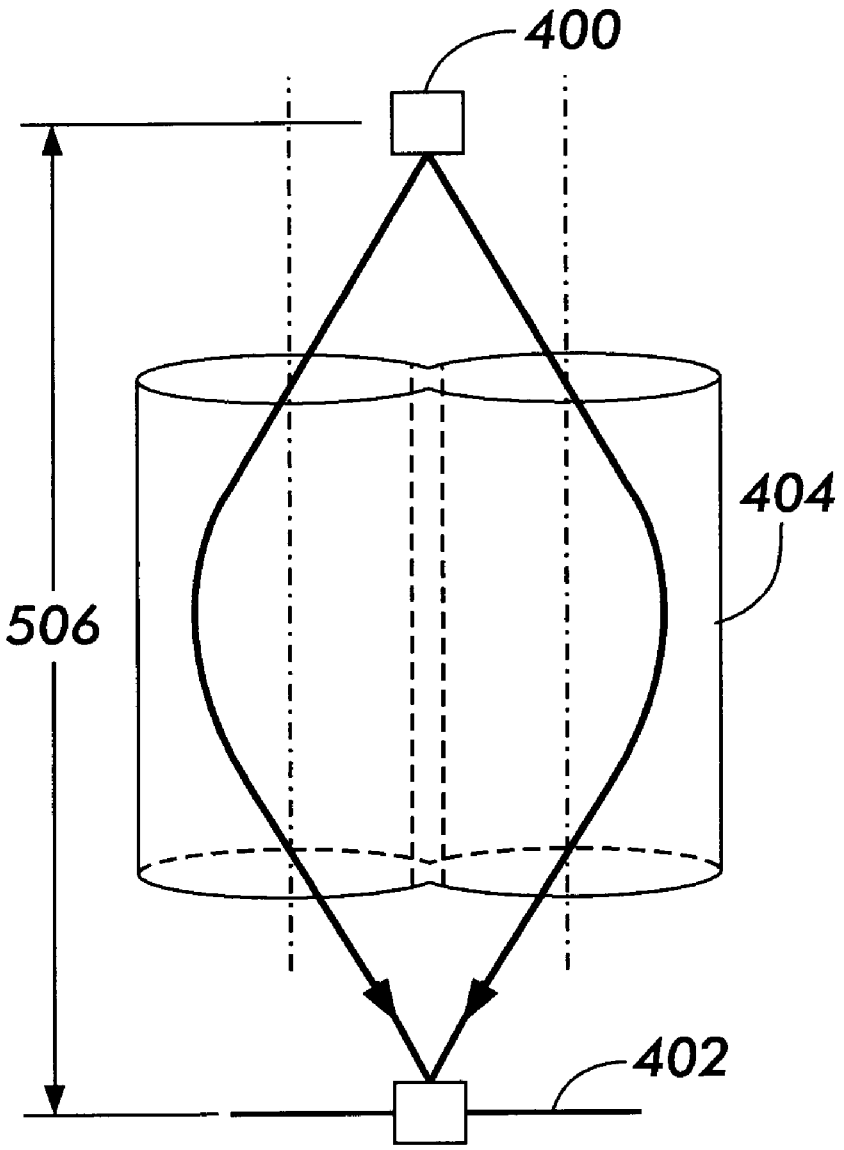
FIG. 5 PRIOR ART
FIG. 5 illustrates a prior art light emitting diode based exposure station.

FIG. 4 shows a general arrangement of components in a light emitting diode based exposure station. An LED array 400 images light onto a photoreceptor 402 by way of a gradient index lens array 404. FIG. 5 shows that arrangement in a prior art system from another perspective. The total conjugate is the distance 506.

Inside a gradient index lens light rays travel sinusoidally, with a focus period of $T=2\pi/A^{1/2}$. A, the gradient constant, is derived from the radial gradient equation $n(r)=n_{0(}1-Ar^2/2)$, where r is the radial distance from the axis of a lens and $n_0$ is the axial refractive index. Currently, gradient index lens arrays use rods (or fibers) with a length that is somewhat less then one focus period.

Figure 6:
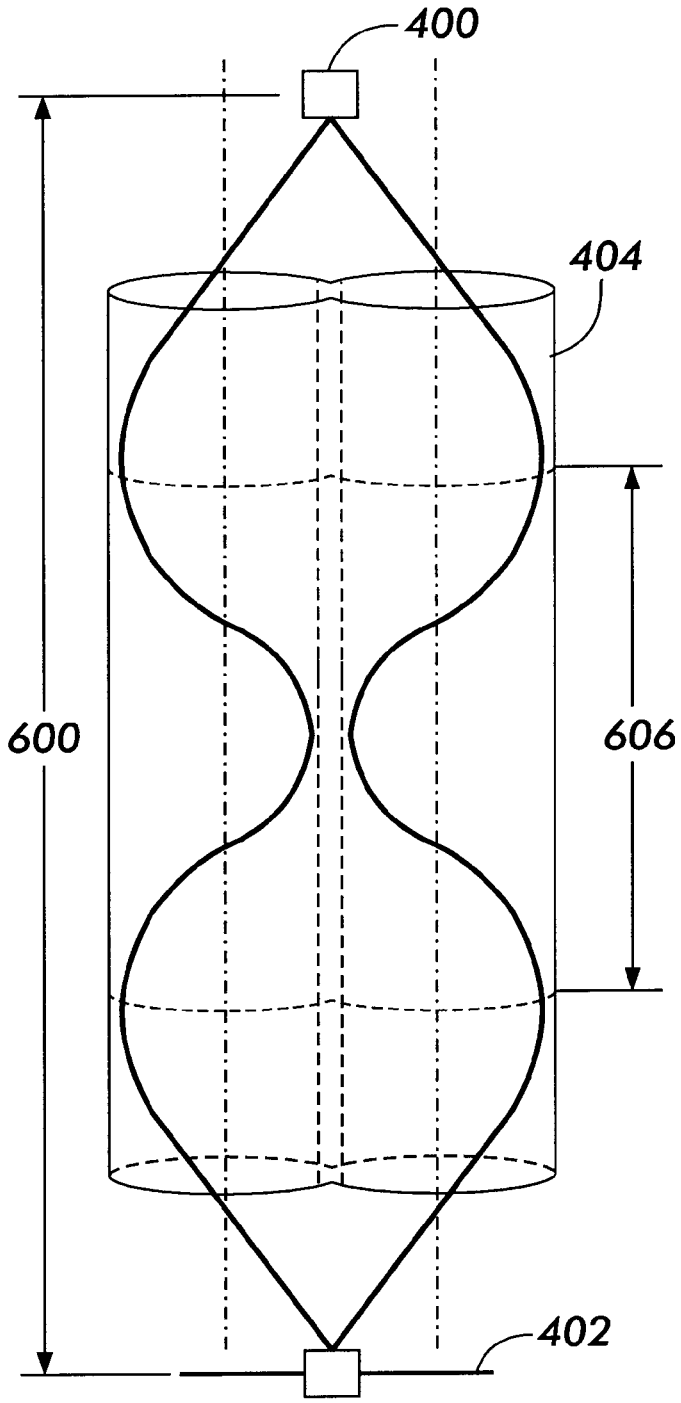
FIG. 6 illustrates an light emitting diode based exposure station according to the principles of the present invention.

Referring now to FIG. 6, one can increase the total conjugate to a distance 600 by lengthening the rods 602 that comprise the gradient index by an integer number of focus periods 606, each $2\pi/A^{1/2}$ long. This enables construction of a light emitting diode based exposure station suitable for the packing arrangement illustrated in FIG. 3 while retaining high radiometric efficiency and resolution.

Figure 7:
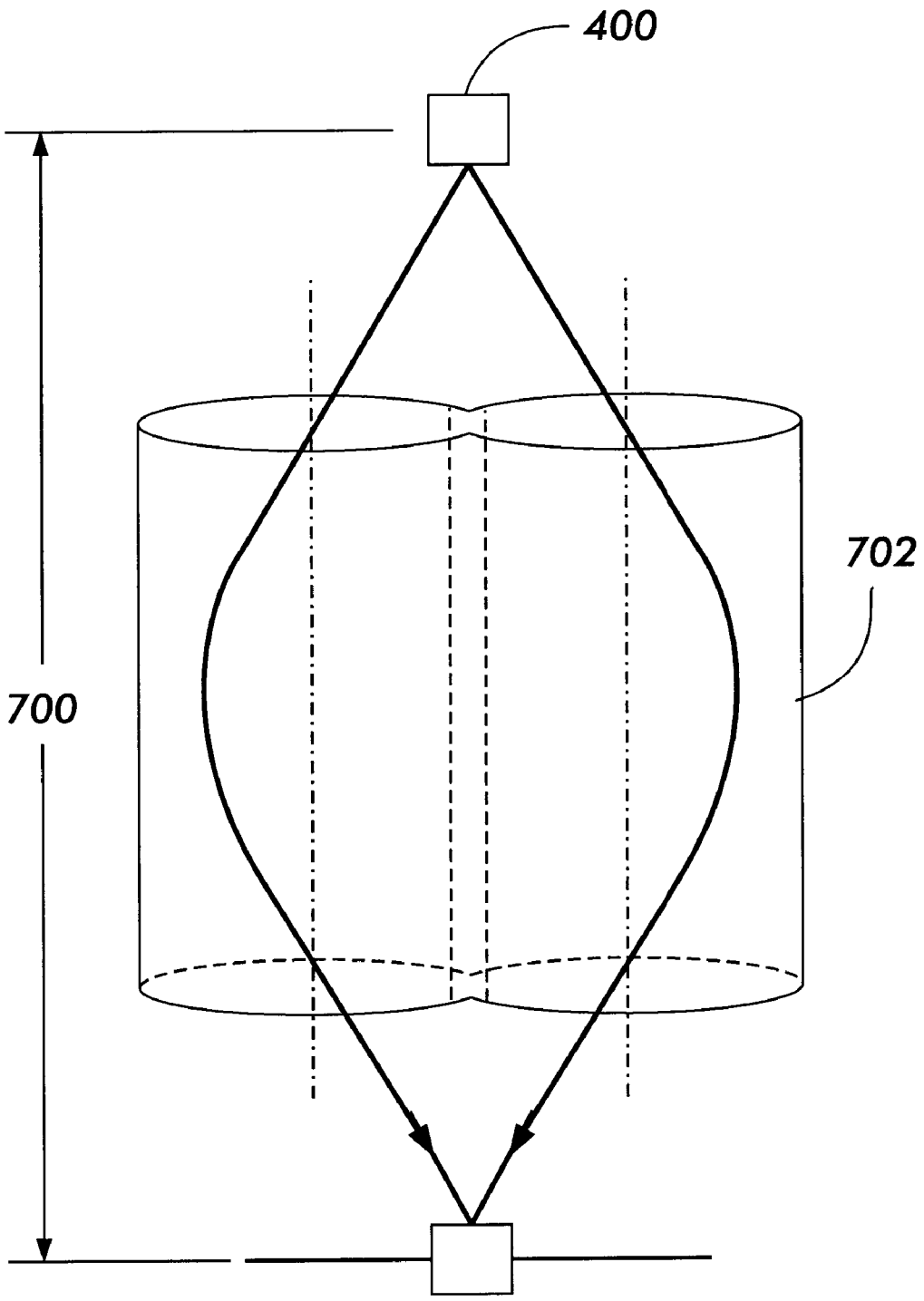
FIG. 7 illustrates another light emitting diode based exposure station according to the principles of the present invention.

Another way of increasing the total conjugate is illustrated in FIG. 7. As shown, the total conjugate 700 is increased making the rods 702 that comprise the gradient-index array with a larger diameter. Then all of the other dimensions of the rods are scaled up by the same amount as the increase in diameter. This scales up the total conjugate by the same amount, without significant detriment to the efficiency and resolution of the gradient-index array.

Of course, both methods of increasing the total conjugate can be used simultaneously. That is, the rod length can be increased by an integer number of focus periods while the rods that comprise the gradient index array can be made with larger diameters and then scaling up the other dimensions.

It is to be understood that while the figures and the above description illustrate the present invention, they are exemplary only. Others who are skilled in the applicable arts will recognize numerous modifications and adaptations of the illustrated embodiments that will remain within the principles of the present invention. Therefore, the present invention is to be limited only by the appended claims.

What is claimed:

1. A printing machine comprising:

a photoreceptor;

a charging device located adjacent said photoreceptor and having a height H, said charging device for charging said photoreceptor;

an exposure device for exposing said charged photoreceptor to produce an electrostatic latent image, said exposure device being adjacent said photoreceptor and adjacent said charging device, said exposure device having a plurality of light emitting diodes in an object plane; a gradient index lens array disposed between said plurality of light emitting diodes and said photoreceptor for focusing light from said plurality of light emitting diodes onto said photoreceptor, wherein said gradient index lens array is comprised of a plurality of gradient index rods; and a cooling assembly in thermal communication with said plurality of light emitting diodes for cooling said plurality of light emitting diodes, wherein said cooling assembly is disposed away from said photoreceptor, and wherein said cooling assembly has a width greater than a width of said gradient index lens array; and a developing station adjacent said photoreceptor and said exposure device, said developing station for depositing toner onto said electrostatic latent image;

wherein said charging device is separated from said developing station by a distance that is less than the width of said cooling assembly.

2. A printing machine according to claim 1, wherein part of said charging device fits below said cooling assembly.

3. A printing machine according to claim 1, wherein part of said developing station fits below said cooling assembly.

4. A printing machine according to claim 3, wherein part of said charging device fits below said cooling assembly.

5. A printing machine according to claim 1, wherein said gradient index rods include an integer number of focus periods.

6. A printing machine according to claim 1, wherein said gradient index lens array has a total conjugate greater than said height H.

7. A printing machine comprising:

a photoreceptor;

a charging device located adjacent said photoreceptor and having a height H, said charging device for charging said photoreceptor;

an exposure device for exposing said charged photoreceptor to produce an electrostatic latent image, said exposure device being adjacent said photoreceptor and adjacent said charging device, said exposure device having a plurality of light emitting diodes in an object plane; a gradient index lens array disposed between said plurality of light emitting diodes and said photoreceptor for focusing light from said plurality of light emitting diodes onto said photoreceptor, wherein said gradient index lens array is comprised of a plurality of gradient index rods; and a cooling assembly in thermal communication with said plurality of light emitting diodes for cooling said plurality of light emitting diodes, wherein said cooling assembly is disposed away from said photoreceptor, and wherein said cooling assembly has a width greater than a width of said gradient index lens array; and a developing station adjacent said photoreceptor and said exposure device, said developing station for depositing toner onto said electrostatic latent image; wherein a part of said charging device is located below said cooling assembly.

8. A printing machine according to claim 7, wherein part of said developing station fits below said cooling assembly.

9. A printing machine according to claim 7, wherein said gradient index rods each include an integer number of focus periods.

10. A printing machine according to claim 7, wherein said gradient index lens array has a total conjugate greater than said height H.

* * * * *